US006378415B1

(12) United States Patent
Sugiura et al.

(10) Patent No.: US 6,378,415 B1
(45) Date of Patent: Apr. 30, 2002

(54) COMPRESSOR

(75) Inventors: Manabu Sugiura; Kazuaki Iwama, both of Kariya; Teiichi Sato, Ohbu, all of (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/521,140

(22) Filed: Mar. 8, 2000

(30) Foreign Application Priority Data

Mar. 17, 1999 (JP) ..... 11-072262

(51) Int. Cl.[7] ..... F01B 3/02
(52) U.S. Cl. ..... 92/71; 92/155
(58) Field of Search ..... 92/71, 155

(56) References Cited

U.S. PATENT DOCUMENTS

| | | | | |
|---|---|---|---|---|
| 3,723,165 A | | 3/1973 | Longo et al. | 117/93.1 |
| 4,683,804 A | * | 8/1987 | Futamura et al. | 92/71 |
| 4,732,818 A | | 3/1988 | Pratt et al. | |
| 5,996,467 A | | 12/1999 | Churgay et al. | 92/71 |
| 6,123,009 A | * | 9/2000 | Kanayama et al. | 92/71 |

FOREIGN PATENT DOCUMENTS

| | | |
|---|---|---|
| EP | 0 890 743 A | 1/1999 |
| JP | A-60-22080 | 2/1985 |
| JP | A-8-199327 | 8/1996 |
| WO | WO 95/25224 | 9/1995 |

* cited by examiner

*Primary Examiner*—F. Daniel Lopez
(74) *Attorney, Agent, or Firm*—Woodcock Washburn LLP

(57) ABSTRACT

The durability of a coating layer formed on the sliding surface between two members of a compressor, and the sliding contact between the two members, is kept excellent over a long period of time. In a peripheral portion 10*d* of a swash plate 10, a pair of shoes 20 are connected to the swash plate 10 while intervening between the swash plate 10 and a piston 8. Both the swash plate 10 and the shoes 20 are formed from an iron series material. A film 23 is formed on both surfaces 22 of the peripheral portion 10*d* of the swash plate 10, and the shoes 20 slide on the film 23 on the swash plate 10. The film 23 is a coating layer formed from a resin containing metallic particles. The particle size of the metallic particles is larger than the thickness of the film 23 (e.g., from 10 to 100 $\mu$m), and the surface of the film 23 is made smooth by polishing. The resin functioning as a binder of the metallic particles is formed from, for example, a polyimide resin.

9 Claims, 2 Drawing Sheets

FIG. 2
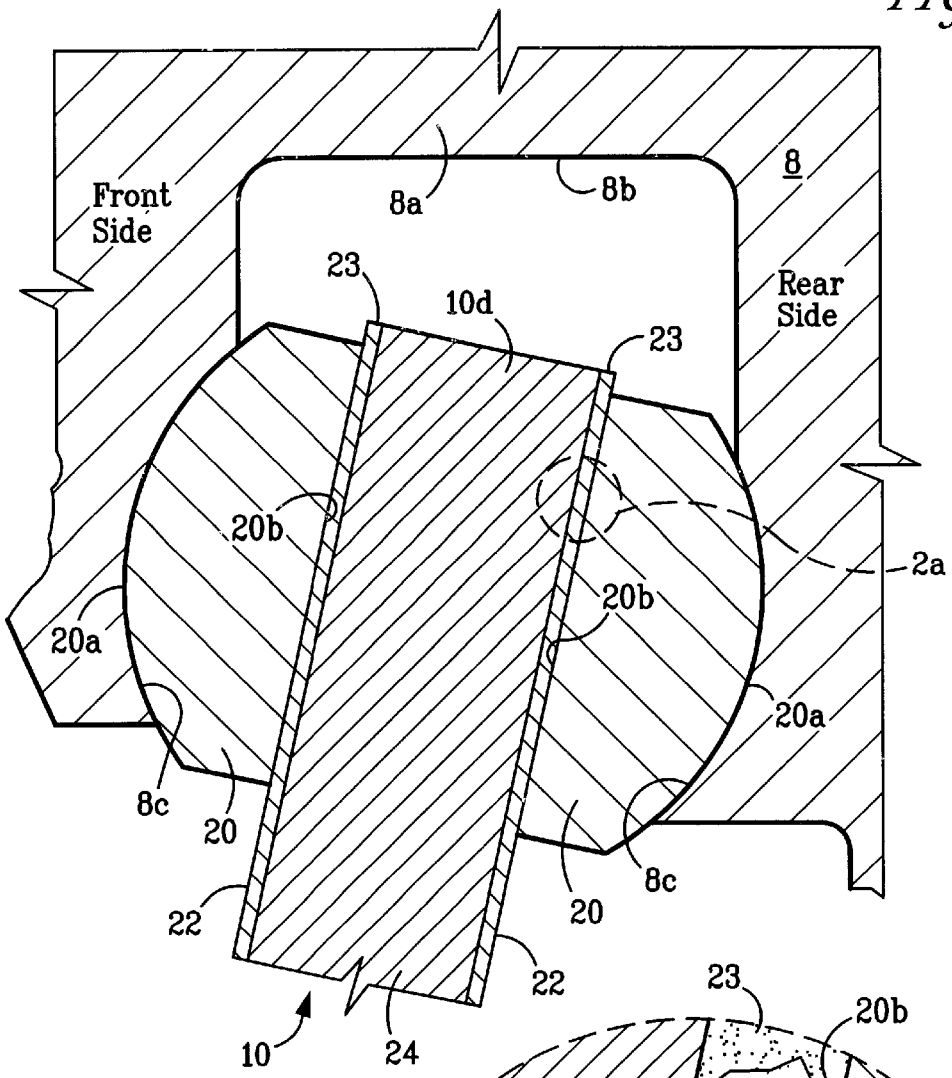
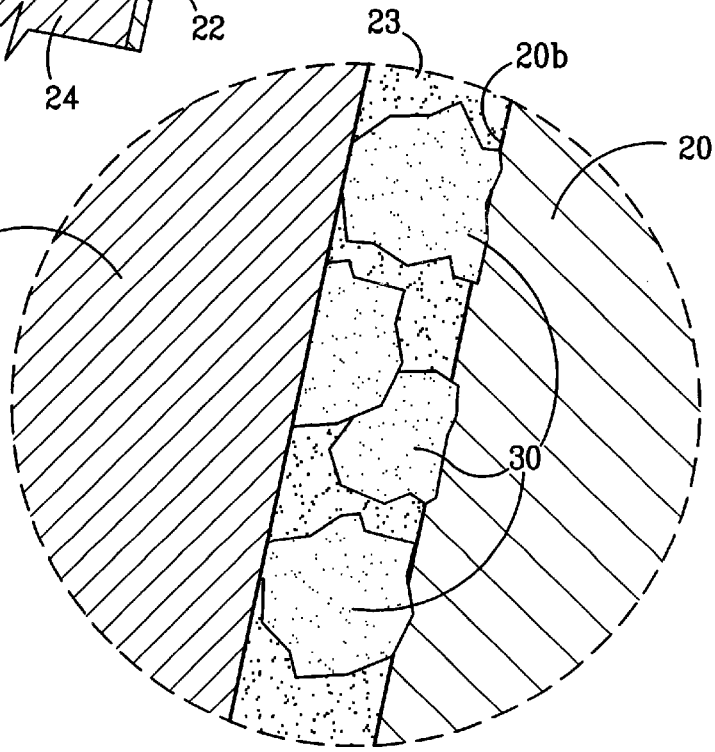
FIG. 2A

COMPRESSOR

BACKGROUND OF THE INVENTION

1. Field of the Invention

The present invention relates to a compressor provided with a first and a second member relatively slidably contacted with each other, and particularly to the improvement in the sliding durability of a coating layer formed on the sliding surface of the two members for the purpose of ensuring contact slidability.

2. Description of the Related Art

In general, a swash type of compressor is provided with a cylinder block forming part of the housing, a plurality of pistons reciprocatively housed in a plurality of cylinder bores which are formed in the cylinder blocks and a swash plate which is fixed on a drive shaft in an inclined state in a crankcase or which is inclination movably provided to the drive shaft. Each of the pistons is movably connected to the peripheral portion of the swash plate through a pair of shoes. The movable connecting construction allows the rotary motion of the drive shaft and the swash plate to be converted into a reciprocating motion of the piston.

For such a swash type of compressor, it has become important to avoid seizure between the swash plate and the pair of shoes which are directly contacted with both surfaces of the peripheral portion of the swash plate, and to reduce friction between the swash plate and the shoes for the reasons explained below. For a swash type of compressor, atomized lubricating oil is carried by a coolant gas and is supplied to each of the portions of the compressor for the purpose of effecting lubrication. However, lubricating oil remaining in and adhering to the sliding surface of the swash plate is washed by the coolant gas before the atomized lubricating oil reaches the swash plate, and the swash plate surface is likely to become dry where the swash plate surface is deficient in lubricating oil. As a result, the swash plate and the shoes are forced to start sliding under dry conditions. The sliding conditions, namely, the sliding environment, of the swash plate is thus very severe. Moreover, so-called new refrigerant, such as R134a, which have recently started to be used in place of conventional cooling refrigerant for the purpose of protecting the ozone layer are more likely to manifest the dry state than the conventional refrigerant. Improvement in the lubricity of the swash plate surface has therefore been required still more.

Conventional technologies which are intended to solve such problems by surface treating the swash plate are disclosed in Japanese Unexamined Patent Publication (Kokai) No. 60-22080 (Japanese Examined Patent Publication (Kokoku) No. 5-10513), International Publication WO 95/25224 and Japanese Unexamined Patent Publication (Kokai) No. 8-199327.

Of these conventional technologies, the technology disclosed in Japanese Unexamined Patent Publication (Kokai) No. 60-22080, for example, comprises forming, on the metallic base material of a swash plate, a solid lubricating layer prepared by binding molybdenum disulfide and graphite with an adhesive such as a phenolic resin. The solid lubricating layer improves the lubricity of the sliding portion surface of the swash plate, makes the contact slidability of the swash plate and the shoes excellent, and improves the seizure resistance of both members.

BRIEF DESCRIPTION OF THE DRAWINGS

FIG. 1 is a longitudinal sectional view of a single headed piston swash type of compressor to which the present invention is applied.

[FIG. 2]

FIG. 2 is an expanded sectional view showing an outline of the relationship between a swash plate and shoes.

[FIG. 2A]

FIG. 2A is expanded view taken from FIG. 2 showing a coating layer comprising particles in accordance with the invention.

SUMMARY OF THE INVENTION

Figure 1:
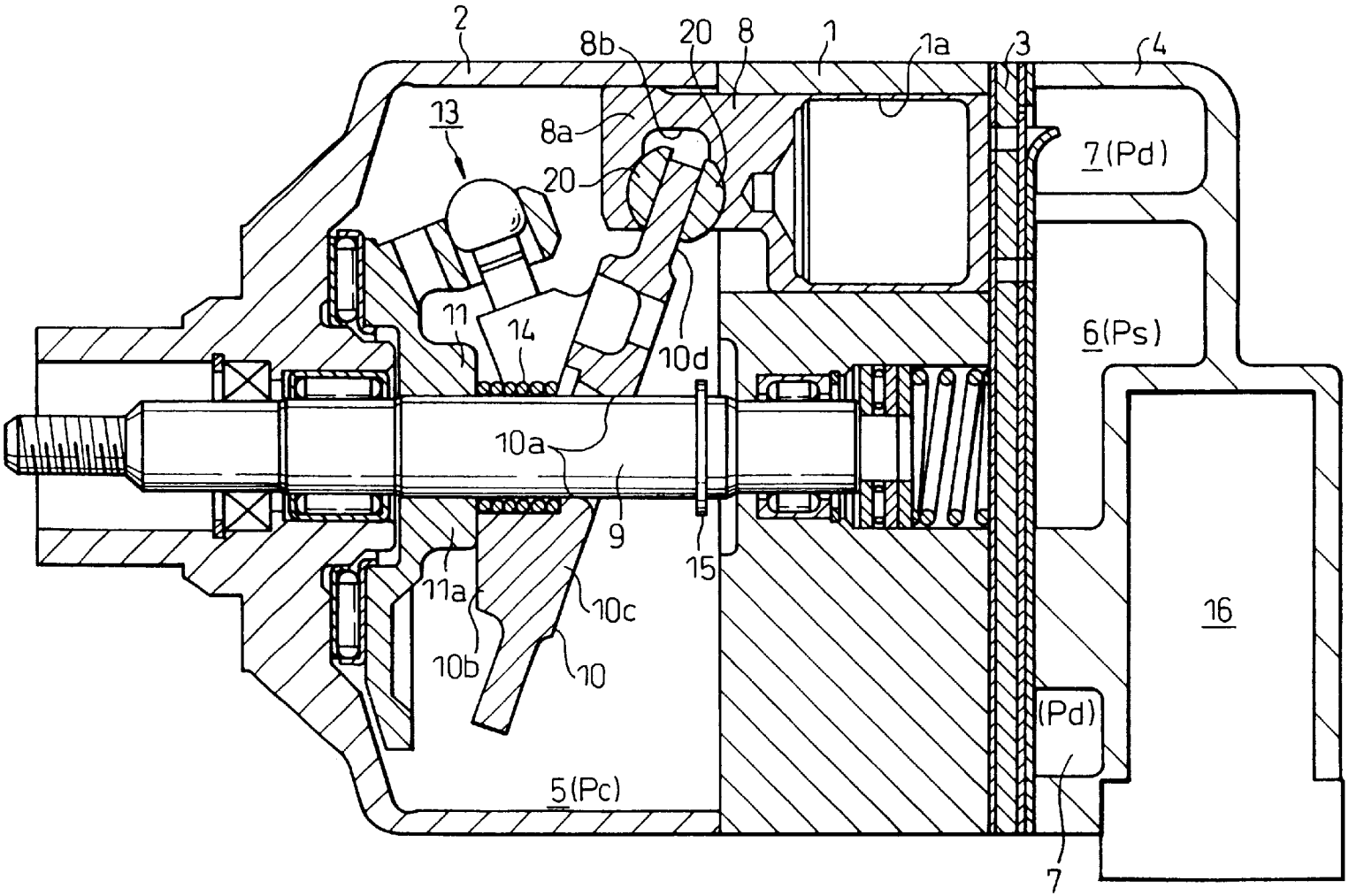
[FIG. 1]

However, although desired lubricity can be obtained by any of the conventional technologies, sufficient durability of the coating layer formed on the sliding surfaces of the swash plate and the shoes has not been obtained. That is, when the swash plate is repeatedly used under dry conditions, the coating layer is sometimes abraded or exfoliated to form a hole, which results in exposure of the base material.

An object of the present invention is to improve the durability of a coating layer formed on the sliding surface between two members, a first and a second member relatively slidably contacted with each other, forming a compressor, and to provide a compressor capable of keeping the contact slidability between the two members excellent over a longer period of time.

The present invention provides a compressor provided with a first and a second member which are relatively slidably contacted with each other, a coating layer which comprises a resin containing metallic particles being formed on at least one of the sliding surface of the first member and that of the second member. The metallic particles present in the resin matrix in the coating layer support a load applied thereto from the sliding surface to relatively reduce the load applied to the resin. Accordingly, the presence of the metallic particles increases the durability of the coating layer. That the presence of the metallic particles increases the durability of the coating layer is a new technological finding.

The compressor to which the present invention is applied is preferably a swash plate type of compressor. The swash plate type of compressor is provided with a swash plate and shoes for connecting the peripheral portion of the swash plate to a piston. The first and the second member which are relatively slidably contacted with each other are the shoes and the swash plate, respectively. The coating layer is formed on at least one of the sliding surfaces. When the coating layer is formed, the coating layer present on the sliding surface of the swash plate and the shoes has high durability; therefore, the slidability of the swash plate and the shoes is kept excellent over a long period of time.

The coating layer is preferably polished to have a thickness up to a value approximate to the particle size of the metallic particles. For example, a liquid-like mixture of metallic particles and a resin is applied to the base material surface of the members, and the coating layer is cured. The surface of the coating layer is then polished until the layer has a thickness up to a value approximate to the particle size of the metallic particles. The metallic particles exposed to the surface of the coating layer are directly contacted with the base material, or they are substantially in contact therewith. The load applied to the sliding surface is mainly supported by the metallic particles, and as a result the load applied to the resin is relatively reduced. The sliding durability of the coating layer is therefore increased further. In addition, "a value approximate to the particle size of the metallic particles" is about the particle size of the metallic particles plus 10% of the particle size.

Moreover, the particle size of the metallic particles is preferably in the range of 10 to 100 μm. When the particle size is less than 10 μm, the coating layer thickness for supporting the load becomes thin. Therefore, the coating layer has little sliding durability. Furthermore, when the particle size exceeds 100 μm, the coating layer must be made thicker than necessary, and as a result a disadvantage related to the adhesion strength such as exfoliation of the coating layer from the base material results in excessive amounts of materials being required.

The content of the metallic particles in the coating layer is at least 30% by volume, and preferably up to the volume ratio above which the resin cannot fill the gaps among the metallic particles. Since the volume ratio of the metallic particles is as high as at least 30% by volume, the sliding durability of the coating layer can be obtained. Moreover, since the volume ratio of the metallic particles is up to the one above which the resin cannot fill the gaps among the metallic particles, there are no gaps in the interior and the surface of the coating layer caused by a deficiency in the resin, and the surface smoothness is maintained, which contributes to the lubricity. Moreover, even when the particle size of the metallic particles is as small as about 10 μm, and smaller than a value approximate to the coating thickness, the metallic particles can be present between the surface of the coating layer and the base material (or the primer coating) while forming groups each including, for example, two or three particles which are connected to each other, if the volume content of the metallic particles is high. Consequently, a load can be firmly supported by the base material through the groups of a plurality of the metallic particles connected together; the load applied to the resin is reduced due to the same principle, and the coating layer has a high sliding durability.

When the coating layer is formed on the surface of only one of the first and the second member, the material of the metallic particles in the coating layer is preferably made to differ from the metallic material of the member on which the coating layer is not formed so that the adhesion of the metallic particles is lowered. Consequently, the metallic particles exposed to the surface of the coating layer are prevented from adhering to the metal of the counterpart member.

Specific examples of the material of the metallic particles include tin, silver, aluminum, copper, zinc, nickel, silicon, cobalt, titanium, tungsten, molybdenum, magnesium, iron and an alloy containing at least one of the metals mentioned above. Only one material selected from the group mentioned above may be used. Alternatively, a plurality of the materials may also be used. Moreover, other solid lubricants may also be added to the coating layer. The solid lubricant is at least one of molybdenum disulfide and graphite.

The resin principally functions as a binder for bonding the metallic particles in a powder form to the base material, etc., of the member. Moreover, part of the resin is exposed to the surface as a matrix of the coating layer to smooth the surface, and contributes to the manifestation of the solid lubricity of the surface. The method of forming a coating layer comprises, for example, applying a liquid-like mixture of the metallic particles and the resin to the sliding surface of the member, and then baking the coating layer at a suitable temperature. Any of the following procedures can be adopted as the application method: spraying; tumbling; transferring; and brushing. Examples of the resin material include epoxy resin, phenolic resin, furan resin, poliamide-imide resin, polyimide resin, polyamide resin, polyacetal resin, fluororesin such as PTFE and unsaturated polyester resin. One of or a combination of a plurality of such resins can be used. In addition, the coating layer can also be formed on the base material through a primer coating (primer coating may be omitted).

DESCRIPTION OF PREFERRED EMBODIMENTS

First, one embodiment of a volume-variable swash plate type of compressor which is the object of the present invention will be briefly explained. As shown in FIG. 1, the swash plate type of compressor is provided with a cylinder block 1, a front housing 2 which is joined to the front end of the cylinder block 1 and a rear housing 4 which is joined to the rear end of the cylinder block 1 through a valve plate 3. These are mutually joined together with a plurality of through bolts (omitted in the figure) to form the housing of the compressor. The interior of the housing is divided into a crankcase 5, an inlet chamber 6 and an outlet chamber 7. A plurality of cylinder bores 1*a* (only one being shown) are formed in the cylinder block 1. A single headed piston 8 is reciprocatively housed in each bore 1*a*. The inlet chamber 6 and the outlet chamber 7 are capable of selectively communicating with each bore 1*a* through flapper valves provided to the valve plate 3.

A drive shaft 9 is rotatably supported in the crankcase 5, and a swash plate 10 regarded as a first member is housed therein. A shaft bore 10*a* is penetratively provided to the central portion of the swash plate 10, and the drive shaft 9 is inserted through the shaft bore 10*a*. The swash plate 10 is movably connected to the drive shaft 9 through a hinge mechanism 13 and a lug plate 11, and is movable, with an inclination, to the drive shaft 9 while synchronously rotating with the drive shaft 9 and sliding in the axial direction of the drive shaft 9; a peripheral portion 10*d* of the swash plate 10 is freely slidably connected to a base end 8*a* of each piston 8 through a pair of shoes (follower acting as a cam) 20, 20, whereby all the pistons 8 are movably connected to the swash plate 10. When the swash plate 10 inclined at a given angle is rotated together with the drive shaft 9, each piston 8 is reciprocated with a stroke in accordance with an inclination angle of the swash plate. In each cylinder bore 1*a*, inlet and compression of a coolant gas from the inlet chamber 6 (region of inlet pressure Ps), and outlet of the compressed refrigerant gas to the outlet chamber 7 (region of outlet pressure Pd) are consecutively repeated.

The swash plate 10 is moved toward a position (inclination angle-decreasing position) near the cylinder block 1 by a spring 14 (a spring for urging the swash plate toward its minimum inclination angle position). However, the minimum inclination angle (e.g., 3 to 5°) of the swash plate 10 is restricted by regulating the sliding of the swash plate 10 toward its inclination angle-decreasing position by, for example, a circlip 15 fixed on the drive shaft 9. On the other hand, the maximum inclination angle of the swash plate 10 is restricted by, for example, the a butting of a counterweight portion 10*b* of the swash plate 10 with a defining portion 11*a* of a lug plate 11.

For the swash plate type of compressor in FIG. 1, the inclination angle of the swash plate 10 can be freely set at an angle between the minimum inclination angle and the maximum inclination angle by adjusting the crank pressure Pc (back pressure of the piston), which is the inner pressure of the crankcase 5, using a displaced control valve 16.

The swash plate 10 has a land 10*c* placed in the central area of the swash plate and an annular peripheral portion 10*d* surrounding the land 10*c*. The land 10*c* is relatively thick compared with the peripheral portion 10*d*, and both the shaft bore 10*a* and the counter weight portion 10*b* are formed in the land 10*c*. Furthermore, the base end 8*a* of the piston 8 is provided with a concave portion 8*b* for admitting the peripheral portion 10*d* of the swash plate 10 and a pair of shoes 20, 20 regarded as the second member.

Next, the surface structure, etc., of the swash plate which is the feature of the present invention will be explained by making reference to FIG. 2. As shown in FIG. 2, each of the pair of shoes 20 has a spherical convex surface 20*a* and a flat plane 20*b*. A pair of spherical concave surfaces 8*c* to be oppositely contacted with the respective spherical convex surfaces 20*a* of the shoes 20 are formed on the internal surface of the concave portion 8*b* of the piston 8. The pair of shoes 20 are slidably guided on the spherical concave surfaces 8*c*. The swash plate 10 is slidably held by the pair of shoes 20 from the front and rear sides while the front and rear surfaces 22 of the peripheral portion 10*d* are contacted with the respective flat planes 20*b* of the shoes 20. That is, the pair of shoes 20 intervening between the pair of spherical concave surfaces 8*c* and the peripheral portion 10*d* of the swash plate 10 are rotatably held by the base end 8*a* of the piston 8, whereby the base end 8*a*of the piston 8 is connected to the peripheral portion 10*d* of the swash plate 10 through the pair of the shoes 20. In addition, of the surface 22 of the peripheral portion 10*d* of the swash plate 10, the portion which slides over the flat plane 20*b* of the shoes 20 becomes the sliding surface of the swash plate side, and the flat planes 20*b* of the shoes 20 become the sliding surfaces of the shoe sides.

The piston 8 is made of an aluminum alloy (e.g., Al-Si alloy), and the swash plate 10 is made of an iron series of material (e.g., cast iron). Moreover, the shoes 20 are formed from a bearing steel which is an iron series of material. In order to lighten the piston 8, an aluminum series of material is used therefore. In order to increase the moment of inertia of the swash plate 10, an iron series of material having a relatively high density is used therefore. Since both the swash plate 10 and the shoes 20 are of an iron series of material, and are composed of metallic materials of the same type, adhesion at the sliding surface is likely to take place. Accordingly, a film 23 regarded as a coating layer for preventing adhesion is formed on the surfaces 22 of the peripheral portion 10*d* of the swash plate 10. The film 23 is formed on the base material 24 of the swash plate 10. The film (coating layer) is preferably made from a resin that comprises metallic particles 30 (as can be seen in FIG. 2A). In addition, the base material 24 of the swash plate 10 on which the film 23 is to be formed is not restricted to an iron series of material; it may also be, for example, an aluminum series of material.

On the surfaces 22 of the peripheral portion 10*d* of the swash plate 10, the film 23 is formed on an area at least including the entire sliding area of the shoes 20. As a result, the shoes 20 slide over the film 23 of the swash plate 10. The internal structure of the film 23 and the methods of forming it will be explained in detail in Examples 1 to 2 shown below.

EXAMPLE

Next, Examples 1 to 2 showing specific instances of a film 23 formed on the surface of a swash plate 10 and Comparative Example belonging to the category of the conventional technology will be explained.

Example 1

An aluminum alloy (12% Si-Al) having a particle size of about 70 μm was used as metallic particles. The aluminum alloy powder and a polyimide resin regarded as a resin were mixed in a mixing ratio of the alloy to the resin of 65 wt % to 35 wt % to give a liquid-like mixture. The surface of the base material of a swash plate formed from an iron series of material was cleaned, and degreased. The liquid-like mixture of a polyimide resin containing dispersed aluminum alloy particles was applied to both peripheral surfaces of the base material of the swash plate by spraying. After the application, the coating was baked at 200° C. to complete film formation. The film surface was polished to form a film 23 having a thickness of about 50 μm.

Example 2

Tin (Sn) having a particle size of about 40 to 50 μm was used as metallic particles. The tin powder and a polyimide resin regarded as a resin were mixed in a mixing ratio of tin to the resin of 80 wt % to 20 wt % to give a liquid-like mixture. The surface of the base material of a swash plate formed from an iron series of material was cleaned and degreased. The liquid-like mixture of a polyimide resin containing dispersed tin particles was applied to both peripheral surfaces of the base material of the swash plate by spraying. After the application, the coating was baked at 200° C. to complete film formation. The film surface was polished to form a film 23 having a thickness of about 50 μm.

Comparative Example

Molybdenum disulfide having a particle size of about 1 μm was used as a solid lubricant. The molybdenum disulfide powder and a polyimide resin regarded as a resin were mixed in a mixing ratio of the molybdenum disulfide to the resin of 60 wt % to 40 wt % to give a liquid-like mixture. The surface of the base material of a swash plate formed from an iron series of material was cleaned and degreased. The liquid-like mixture of a polyimide resin containing dispersed molybdenum disulfide particles was applied to both peripheral surfaces of the base material of the swash plate by spraying. After the application, the coating was baked at 200° C. to complete film formation. The film surface was polished to form a film 23 having a thickness of about 50 μm.

Method and Evaluation of Durability Test

Assuming that the actual machine was a swash type of compressor into which a swash plate such as the one in any of Examples and Comparative Examples mentioned above was incorporated as shown in FIG. 1, an acceleration testing machine was used, and a continuous sliding durability test was conducted between the swash plate and the shoes. In the testing machine, two pairs of shoes were arranged on the peripheral surface of the swash plate at two respective sites situated at both respective end portions of a diameter of the swash plate, in such a manner that the respective end faces of the shoes were contacted with the peripheral surface and were placed in a state where the shoes press-contacted the swash plate surface due to forces from two springs. The swash plate was rotated at high speed in such a state. The contact pressure between the shoes and the swash plate was set in accordance with the actual machine. Moreover, in the test, a state immediately after starting the actual machine was estimated, and lubricating oil conditions (fluid lubrication conditions) in an oilless environment (assuming that the amount of the lubricating oil being about 10% of an ordinary one) were adopted. The number of revolution of the swash plate was determined to be 9,200 rpm which is about twice the number of ordinary revolution of the actual machine, and the swash plate was rotated at the rotation speed for 8 hours.

Table 1 summarizes the material construction of the swash plates in Example 1 to 2 and Comparative Example, and the test results. Occurrence of troubles such as seizure between the shoes and the swash plate was visually observed after the test. In each of Examples 1 to 2 wherein a film 23 comprising a mixture of aluminum alloy particles or tin particles and a polyimide resin was formed on the peripheral surface of a swash plate, neither the sliding surface of the swash plate nor that of the shoes showed abnormality. In contrast, in Comparative Example wherein a solid lubricating layer is formed on the peripheral surface of a swash plate, abnormality related to seizure was observed to some degree on the surface. Since the solid lubricating layer produces effects to some degree in the actual machine, the films in Examples 1 to 2 were confirmed to be more excellent than the solid lubricating layer, in view of the sliding durability.

TABLE 1

| | Material construction of a swash plate Film | | | |
|---|---|---|---|---|
| | Particles contained | Resin | Base Material | Test Results |
| Example 1 | Al—Si series of alloy 70 $\mu$m | Polyimide | Fe series | No abnormality ○ |
| Example 2 | Sn 40 to 50 $\mu$m | Polyimide | Fe series | No abnormality ○ |
| Comparative Example | $MoS_2$ 1 $\mu$m | Polyimide | Fe series | Seizure Δ |

In addition, the mode of operation of the present invention is not restricted to that mentioned above. The present invention can also be operated in the embodiments (A) to (F).

(A) A solid lubricant can also be added to the coating layer. Examples of the solid lubricant include molybdenum disulfide, tungsten disulfide, graphite, boron nitride, antimony oxide, lead oxide, lead (Pb), indium (In), tin (Sn) and PTFE. The solid lubricant component to be used is preferably at least one substance selected from the group mentioned above. Moreover, a plurality of the substances can also be used in a mixture as the solid lubricant component.

In addition, although the solid lubricant component includes metal, the metal differs from the metallic particles of the present invention in that the metallic particles are particles (particulate). Moreover, the particle size of the metallic particles is preferably at least a value approximate to the thickness of the coating layer, and larger than the particle size of the solid lubricant in powder. Furthermore, the morphology of the metallic particles preferably is isotropic. When the morphology of the metallic particles is anisotropic, for example, scale-like (flake-like) or needle-like, the metallic particles come to be oriented in the coating layer (film 23) in the layer direction. The coating layer therefore does not have sliding durability. Still further, the content of the metallic particles is preferably high. For example, the content is preferably at least 30% by volume, more preferably at least 40% by volume, and most preferably at least 50% by volume. When the volume content of the metallic particles is high, that is, when the filling factor is high, the metallic particles easily support the load, and contribute to the improvement in the sliding durability of the coating layer.

(B) The particle size of the metallic particles may be smaller than a size approximate to the thickness of the coating layer (film 23). For example, the particle size of the metallic particles is determined to be from 10 to 20 $\mu$m, and the thickness of the coating layer can be made about twice the particle size thereof. In this case, when the volume ratio of the metallic particles is high, the metallic particles are present between the coating layer surface and the base material surface while they are linked to each other. As a result, the metallic particles effectively support the load to increase the sliding durability of the coating layer.

(C) A primer coating different from the base material may also be formed below the film 23. For example, a copper alloy layer can be formed as the primer coating by a procedure such as thermal spraying.

(D) The surface of the base material 24 of the swash plate 10 can be surface roughened (the surface roughness being, for example, from 3 to 10 $\mu$m) to improve the adhesion of the film 23 to the base material 24.

(E) The portion to which the present invention can be applied is not restricted to the sliding portion between the swash plate and the shoes, but the present invention may be applied to the contact sliding portions (a) to (c) shown below. That is, examples of a combination of the first and the second member are mentioned below:

(a) A portion between the shoes 20 and the piston 8;

(b) A portion between the drive shaft 9 and the swash plate 10; and (c) A portion between the peripheral surface of the piston 8 and the inner surface of the cylinder bore 1*a* of the cylinder block 1

(F) The application of the present invention is not restricted to the swash type of compressor, but it may be applied to another type of compressor such as a scroll type of compressor.

The technical ideas other than those in the claims but shown in the above embodiments and other instances will be described below.

(1) The content of the metallic particles is at least 40% by volume.

(2) In the technical idea mentioned in (1), the content thereof is at least 50% by volume.

(3) The particle size (average particle size) of the metallic particles is in the range of 30 to 80 $\mu$m. In this case, the sliding durability of the coating layer is increased and thickness control of the coating layer becomes easy.

As explained above in detail, the present invention improves the durability of the coating layer formed on the sliding surface between two members forming a compressor, and can preserve the contact slidability between the two members excellent over a long period of time.

What is claimed is:

1. A compressor provided with a first and a second member which are relatively slidably contacted with each other, a coating layer, which comprises a resin containing metallic particles, being formed on at least one of the sliding surface of the first member and that of the second member, and being polished to have a thickness up to a value approximate to the particle size of the metallic particles such that at least a portion of the metallic particles are exposed.

2. The compressor according to claim 1, wherein the compressor is a swash plate type of compressor, the swash plate type of compressor is provided with a swash plate and shoes for connecting the peripheral portion of the swash plate to a piston as the first and the second member which are relatively slidably contacted with each other, and the coating layer is formed on at least one of the swash plate surface and the sliding surface of the shoes.

3. The compressor according to claim 1, wherein the resin material is one or a plurality of materials selected from the group consisting of epoxy resin, phenolic resin, furan resin, poliamideimide resin, polyimide resin, polyamide resin, polyacetal resin, fluororesin and unsaturated polyester resin.

4. The compressor according to claim 1, wherein the particle size of the metallic particles is in the range from 10 to 100 $\mu$m.

5. The compressor according to claim 1, wherein the content of the metallic particles is at least 30% by volume and up to the volume ratio above which the resin cannot fill the gaps among the metallic particles.

6. The compressor according to claim 1, wherein the coating layer is formed only on one of the first and the second member, and the material of the metallic particles in the coating layer differs from the member on which the coating layer is not formed, and shows poor adhesion thereto.

7. The compressor according to claim 1, wherein the material of the metallic particles is composed of one or a plurality of substances selected from the group consisting of tin, silver, aluminum, copper, zinc, nickel, titanium, tungsten, molybdenum, magnesium, iron and an alloy containing at least one of the metals mentioned above.

8. The compressor according to claim 1, wherein the coating layer contains a solid lubricant.

9. The compressor according to claim 8, wherein the solid lubricant is at least one of molybdenum disulfide and graphite.

* * * * *